US010784570B2

(12) United States Patent
Wu et al.

(10) Patent No.: US 10,784,570 B2
(45) Date of Patent: Sep. 22, 2020

(54) LIQUID-CRYSTAL ANTENNA DEVICE

(71) Applicant: InnoLux Corporation, Miao-Li County (TW)

(72) Inventors: Yan-Zheng Wu, Miao-Li County (TW); I-Yin Li, Miao-Li County (TW); Kuang-Chiang Huang, Miao-Li County (TW); Chien-Hung Chan, Miao-Li County (TW); Huang-Chi Chao, Miao-Li County (TW); Chih-Yung Hsieh, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 210 days.

(21) Appl. No.: 15/989,533

(22) Filed: May 25, 2018

(65) Prior Publication Data

US 2018/0375201 A1 Dec. 27, 2018

Related U.S. Application Data

(60) Provisional application No. 62/523,336, filed on Jun. 22, 2017.

(30) Foreign Application Priority Data

Nov. 20, 2017 (CN) ..... 2017 1 1159864

(51) Int. Cl.
*H01Q 1/38* (2006.01)
*H01Q 21/00* (2006.01)

(52) U.S. Cl.
CPC ..... *H01Q 1/38* (2013.01); *H01Q 21/0068* (2013.01); *G09G 2300/0876* (2013.01)

(58) Field of Classification Search
CPC ..... H01Q 1/38; H01Q 1/50; H01Q 21/00; H01Q 21/0068; H01Q 23/00
See application file for complete search history.

(56) References Cited

U.S. PATENT DOCUMENTS

2004/0257271 A1* 12/2004 Jacobson ..... G01S 7/282 342/175
2012/0127389 A1* 5/2012 Nagami ..... G02F 1/134309 349/47

(Continued)

FOREIGN PATENT DOCUMENTS

CN 105448255 A 3/2016
WO 2017/061527 A1 4/2017

OTHER PUBLICATIONS

Chinese language office action dated Nov. 25, 2019, issued in application No. CN 201711159864.8.

*Primary Examiner* — Hoang V Nguyen
(74) *Attorney, Agent, or Firm* — McClure, Qualey & Rodack, LLP

(57) ABSTRACT

A liquid-crystal antenna device includes a signal source, a driving module, a correction module, and a plurality of radiation units. The signal source provides an input electromagnetic wave. The driving module outputs a plurality of initial voltage signals according to a radiation address. The correction module receives the initial voltage signals and outputs a plurality of corrected voltage signals according to a lookup table. The radiation units respectively receive the corrected voltage signals and are coupled to the input electromagnetic wave to generate an output electromagnetic wave.

17 Claims, 7 Drawing Sheets

(56) References Cited

U.S. PATENT DOCUMENTS

| | | | | |
|---|---|---|---|---|
| 2014/0211135 | A1* | 7/2014 | Jung | G02F 1/133788 349/106 |
| 2016/0230096 | A1* | 8/2016 | Ogawa | C09K 19/2014 |
| 2016/0372834 | A1 | 12/2016 | Bily et al. | |
| 2017/0170572 | A1 | 6/2017 | Severson et al. | |
| 2018/0337446 | A1 | 11/2018 | Nakazawa et al. | |

* cited by examiner

LIQUID-CRYSTAL ANTENNA DEVICE

CROSS REFERENCE TO RELATED APPLICATIONS

This application claims the benefit of U.S. Provisional Applications No. 62/523,336 filed on Jun. 22, 2017, and the entirety of which is incorporated by reference herein.

This application claims priority of China Patent Application No. 201711159864.8 filed on Nov. 20, 2017, and the entirety of which is incorporated by reference herein.

BACKGROUND

Technical Field

The disclosure relates to a liquid-crystal antenna device, and in particular to a liquid-crystal antenna device whose voltage signal received by a radiation unit is corrected.

Description of the Related Art

In a liquid-crystal antenna unit, different dielectric coefficients are generated by controlling the direction of rotation of a liquid crystal via an electric field due to the bi-dielectric coefficient characteristic of the liquid crystal.

In the liquid-crystal antenna unit array, by using the electric signal to control the arrangement of the liquid-crystal in each liquid-crystal antenna unit to change the dielectric coefficient of each unit in the microwave system, this can be used to control the phase or the amplitude of the microwave signal in the antenna unit. The liquid-crystal antenna unit array radiates electromagnetic waves toward a predetermined direction after collocation.

The microwave signals can be searched for and the angle for receiving and emitting radiation can be adjusted with the signal source to enhance the communication quality by controlling the liquid-crystal antenna unit array. The signal sources may be space satellites, terrestrial base stations, or other signal sources.

Wireless communication of liquid-crystal antenna can be used in a variety of vehicles, such as aircrafts, yacht boats, trains, cars and motorcycles, etc., or the Internet of Things, autonomous driving, and unmanned vehicles, etc. Comparing to conventional mechanical liquid-crystal antenna, the electronic one has some advantages such as flat, thin and light, and fast response, etc.

However, a liquid-crystal antenna is made of a plurality of radiation units, and the process uniformity of each radiation unit is still poor, which results in a distortion of the output electromagnetic wave. Therefore, there is a need to provide improvement solutions for a liquid-crystal antenna.

SUMMARY

The present disclosure provides a liquid-crystal antenna device, including: a signal source, providing an input electromagnetic wave, a driving module, outputting a plurality of initial voltage signals according to a radiation address, a correction module, receiving the initial voltage signals and outputting a plurality of corrected voltage signals according to a lookup table, and a plurality of radiation units, receiving the corrected voltage signals and coupling with the input electromagnetic wave to generate an output electromagnetic wave.

The present disclosure provides a liquid-crystal antenna device, including: a plurality of radiation units, emitting or receiving an electromagnetic wave, wherein the radiation units include a first radiation unit, a driving module, outputting a plurality of initial voltage signals according to a radiation address, wherein the initial voltage signals include a first voltage signal corresponding to the first radiation unit, and a correction module, receiving the initial voltage signals and outputting a plurality of corrected voltage signals to the radiation units, and wherein the corrected voltage signals include a second voltage signal corresponding to the first radiation unit, wherein the first voltage signal is different from the second voltage signal.

A detailed description is given in the following embodiments with reference to the accompanying drawings.

DETAILED DESCRIPTION

Figure 1:
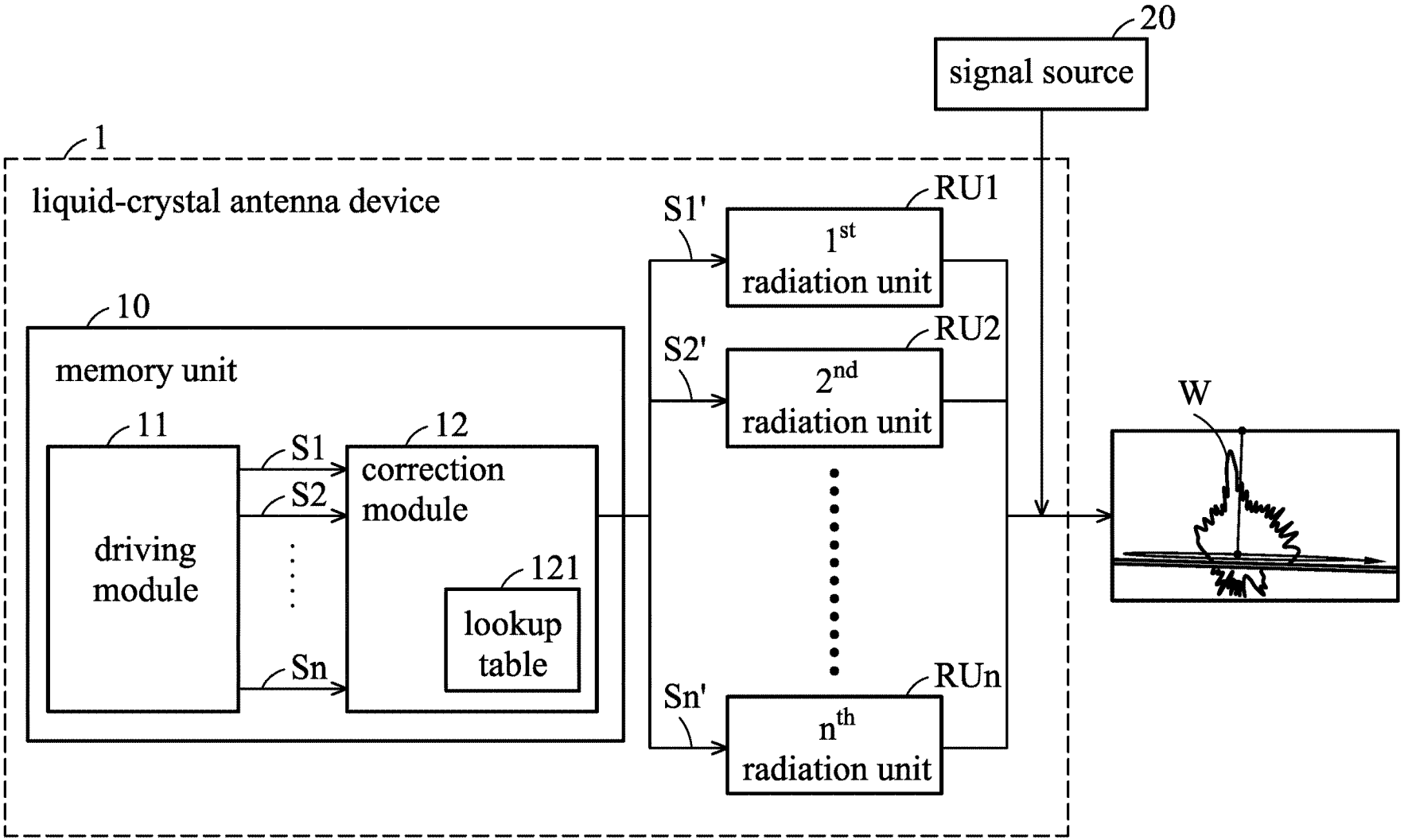
FIG. 1 is a diagrammatic view of a liquid-crystal antenna device of an embodiment of the present disclosure.

The following disclosure provides many different embodiments, or examples, for implementing different features of the subject matter provided. Specific examples of components and arrangements are described below to simplify the present disclosure. These are merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

In addition, the present disclosure may repeat reference numerals and/or letters in the various examples. This repetition is for the purpose of simplicity and clarity and does not in itself dictate a relationship between the various embodiments and/or configurations discussed.

The terms such as the first and the second in the present disclosure are merely for clarity and are not intended to correspond to or limit the scope of the patent. In addition, the terms such as the first feature and the second feature are not limited to the same or different features.

Spatially relative terms, such as "below" or "above," and the like, are merely used herein for ease of description to describe one element or feature's relationship to another element(s) or feature(s) as illustrated in the figures. The spatially relative terms are intended to encompass different orientations of the device in use or operation in addition to the orientation depicted in the figures. For clarity, the description of the first feature disposed on the second feature or the lower means that the first feature is on or under the second feature in the stacking direction of the figures in the present disclosure.

The shape, size, and thickness in the drawings may not be drawn to scale or simplified for clarity of discussion; rather, these drawings are merely intended for illustration.

FIG. 1 is a diagrammatic view of a liquid-crystal antenna device 1 of an embodiment of the present disclosure. A liquid-crystal antenna device 1 can be used to emit an electromagnetic wave signal, which includes a memory unit 10, a signal source 20, and a plurality of radiation units RU1, RU2 . . . RUn. The memory unit 10 includes a driving module 11 and a correction module 12, wherein the driving module 11 according to a radiation address outputs a plurality of initial voltage signals S1, S2 . . . Sn, the correction module 12 receives the initial voltage signals S1, S2 . . . Sn and then outputs a plurality of corrected voltage signals S1', S2' Sn', and the radiation units RU1, RU2 . . . RUn receive the corrected voltage signals S1', S2' . . . Sn' and are coupled to an input electromagnetic wave provided by the signal source 20 to generate an output electromagnetic wave W, and emit the output electromagnetic wave W to the radiation address. In the embodiment, the correction module 12 outputs the corrected voltage signals S1', S2' . . . Sn' according to a lookup table 121, but are not limited thereto. In the embodiment, the radiation address is defined by the zenith angle θ and the azimuth angle φ of a Spherical coordinate system. And, at least one of the plurality of initial voltage signals is different from at least one of the plurality of corrected voltage signals.

The liquid-crystal antenna device 1 mentioned above outputs a plurality of the corrected voltage signals S1', S2' . . . Sn' to the radiation units RU1, RU2 . . . RUn through the correction module 12 in order to adjust the liquid-crystal capacitance value of the radiation units RU1, RU2 . . . RUn to control the resonance frequency of the liquid-crystal antenna device 1. When the resonance frequency of the liquid-crystal antenna device 1 matches the frequency of the input electromagnetic wave provided by the signal source 20, the liquid-crystal antenna device 1 will emit the electromagnetic wave W to the radiation address.

Figure 2:
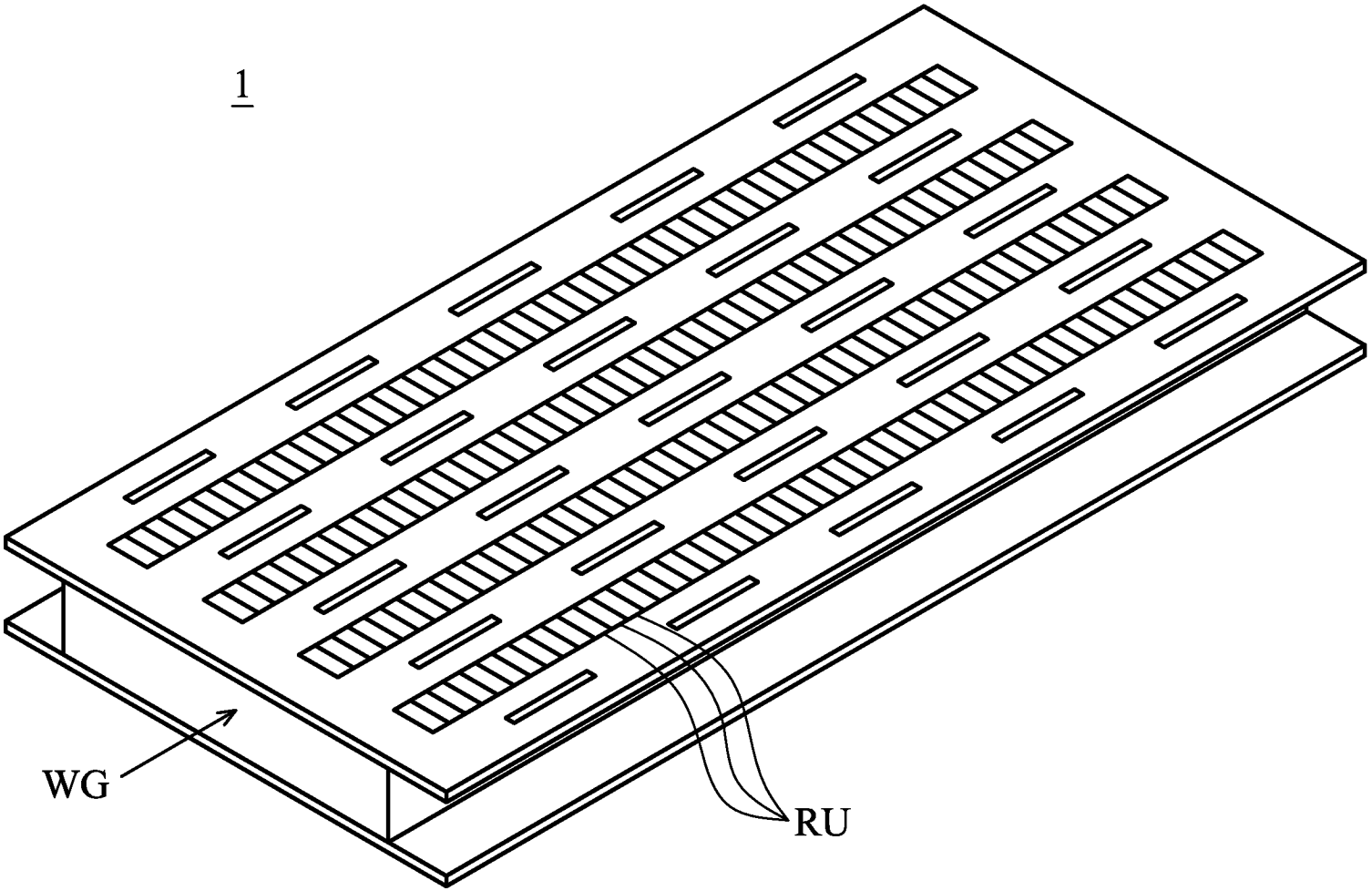
FIG. 2 is a schematic perspective view of the liquid-crystal antenna device of FIG. 1.

FIG. 2 is a schematic perspective view of the liquid-crystal antenna device 1 of FIG. 1. The liquid-crystal antenna device 1 includes a plurality of arrayed radiation units RU (including the aforementioned radiation units RU1, RU2, . . . , RUn) and a waveguide WG, wherein the arrangement of a plurality of arrayed radiation units RU may vary by design, and are not intended to be limited. After correction by the aforementioned correction mechanism, the phase difference and the amplitude of the electromagnetic wave emitting into space may be controlled by each radiation unit RU so as to stack and form the electromagnetic wave W. The waveguide WG transmits the electromagnetic wave from the signal source 20 to the radiation units RU.

Figure 3:
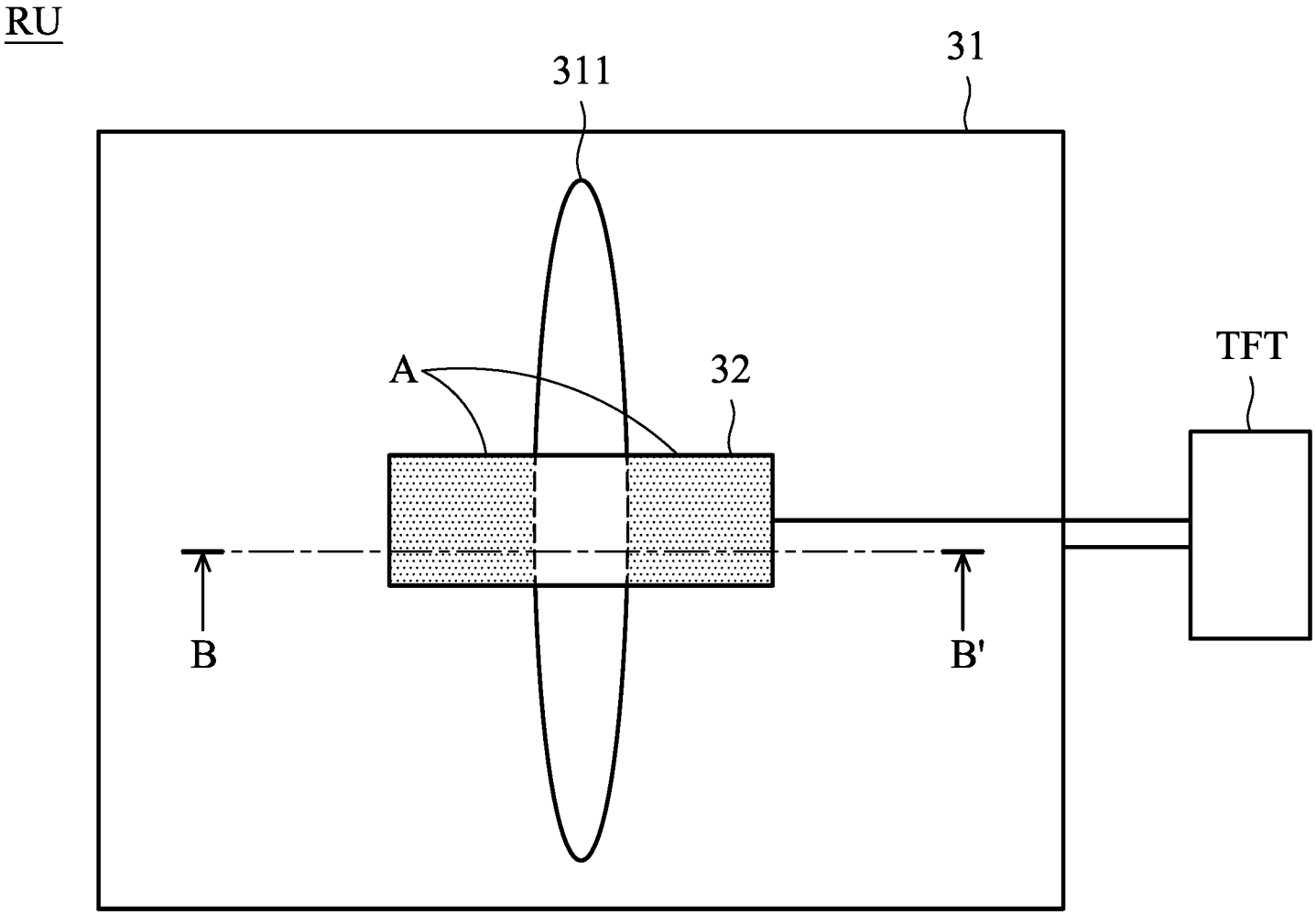
FIG. 3 is a top view of the radiation unit in FIG. 2.
Figure 4:
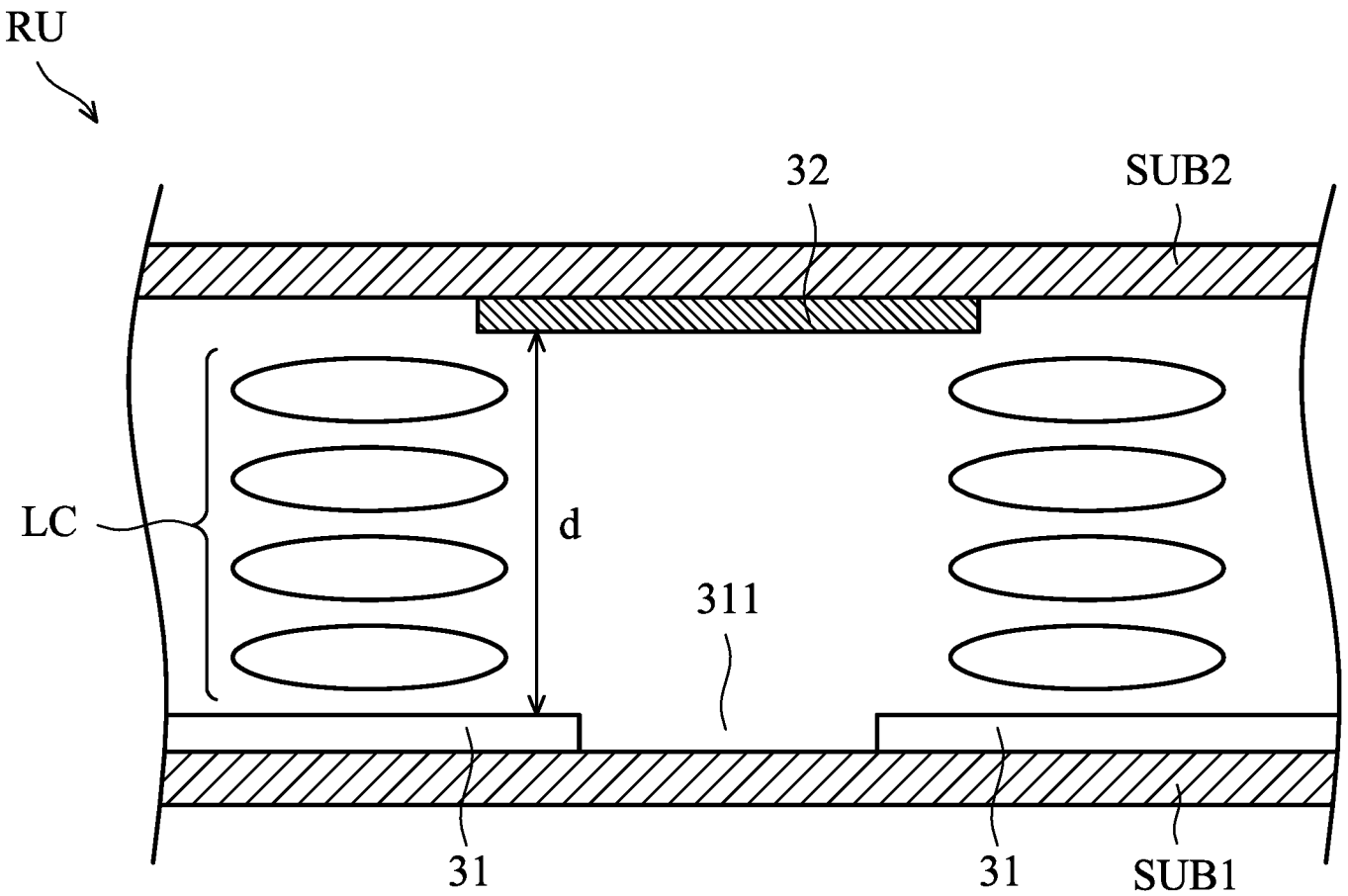
FIG. 4 is a cross-sectional view along line B-B' in FIG. 3.

Referring to FIG. 3 and FIG. 4, FIG. 3 is a top view showing one of the radiation units in FIG. 2, and FIG. 4 is a cross-sectional view along line B-B' in FIG. 3. The radiation unit RU includes a common electrode 31, a pixel electrode 32, and a thing film transistor TFT. The common electrode 31 and the pixel electrode 32 are disposed respectively on a first substrate SUB1 and a second substrate SUB2, and the thin film transistor TFT electrically connects to the common electrode 31 and the pixel electrode 32 respectively, wherein the thin film transistor TFT may be used to transmit the aforementioned corrected voltage signals to the pixel electrode 32. In another embodiment, the thin film transistor TFT electrically connects to the pixel electrode 32, and a common voltage source electrically connects to the common electrode 31. The common electrode 31 and the pixel electrode 32 may be a metal thin layer, which may be made of or include copper, silver, gold, aluminum, any suitable materials or a combination alloy thereof. The common electrode 31 and the pixel electrode 32 may also be a transparent conductive thin layer, which may be made of or include indium tin oxide (ITO), indium zinc oxide (IZO), indium gallium zinc aluminum oxide (IGZAO), any suitable transparent conductor or a combination thereof. The common electrode 31 and the pixel electrode 32 may be any suitable conductor and are not limited thereto, wherein the common electrode 31 is formed with a slit 311, so that the electromagnetic wave transmitting in the waveguide (not shown) under the common electrode 31 may be radiated to the liquid-crystal layer LC between the common electrode 31 and the pixel electrode 32. In some embodiments, the pixel electrode 32 overlaps the slit 311.

The first substrate SUB1 and the second substrate SUB2 may be made of or include quartz, glass, wafer, metal foil, polymethylmethacrylate (PMMA), polyimide (PI), polyethylene terephthalate (PET), polyethylene naphthalate (PEN), and polybutylene naphthalate (PBN), but are not limited thereto, and any material applicable for the first substrate SUB1 and the second substrate SUB2 may be used. Liquid-crystal layer LC may include a plurality of liquid-crystal molecules.

Still referring to FIG. 3 and FIG. 4, assuming that every radiation unit RU has the same size, the liquid-crystal capacitance of every radiation unit RU can be regarded as an ideal capacitance. The Equation 1 below can be simplified as a function of voltage when the size of the ideal capacitance is fixed, which means that all of the radiation units RU can have a consistent liquid-crystal capacitance $C_{LC}$ via an initial voltage-capacitance curve $C_{initial}$ (as shown in FIG. 5) when inputting a specific voltage value:

$$C_{LC} = \varepsilon_{LC}(V)\frac{A}{d} \quad \text{(Equation 1)}$$

Here, $\varepsilon_{LC}(V)$ is a relation of the liquid-crystal dielectric coefficient to the applied voltage difference, A is the sum of overlapping areas of the common electrode 31 and the pixel electrode 32 in FIG. 3, d is the distance between the common electrode 31 and the pixel electrode 32 in FIG. 4.

Figure 5B:
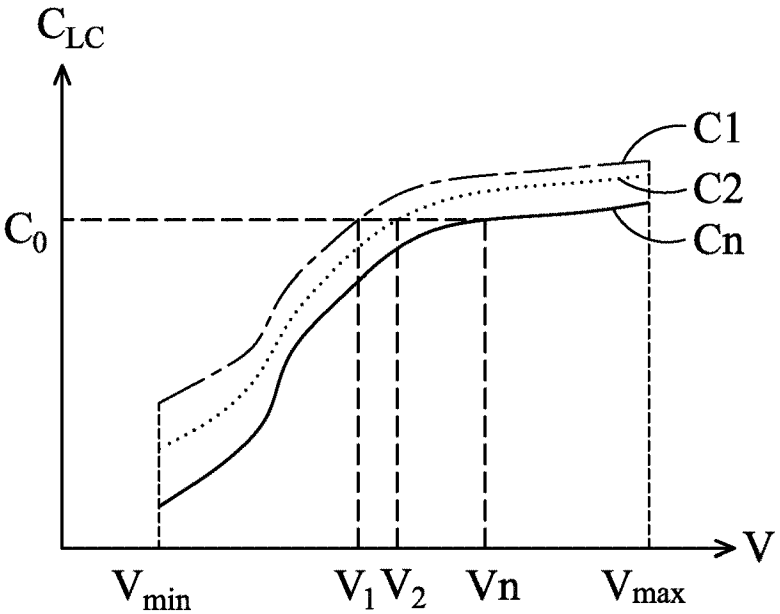
FIG. 5B is a graph illustrating a relationship between voltage and capacitance of the radiation unit in FIG. 1 in the practical state.
Figure 5A:
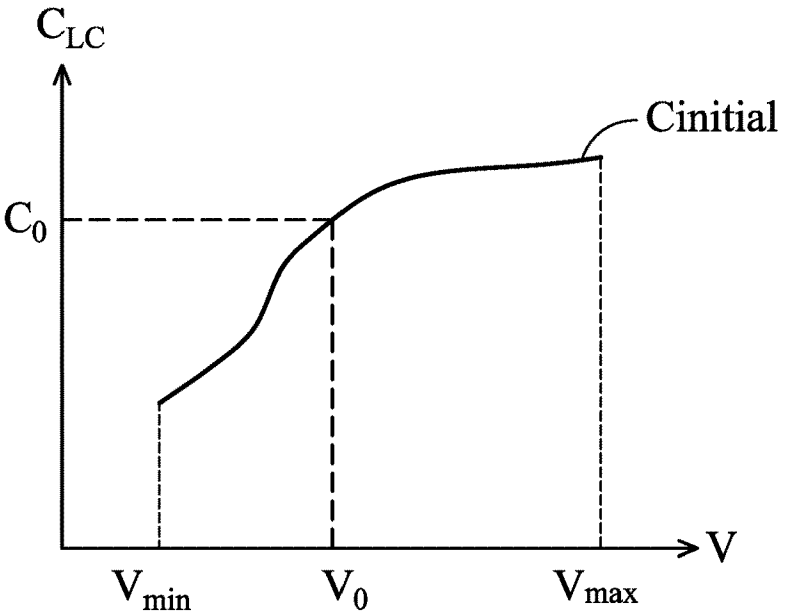
FIG. 5A is a graph illustrating a relationship between voltage and capacitance of the radiation unit in FIG. 1 in the ideal state.

However, the actual size of each radiation unit RU may have slight difference due to the process capability of precision is limited. Therefore, every radiation unit RU will each have their own corrected voltage-capacitance curve C1, C2 . . . Cn (as shown in FIG. 5B). The corrected voltage-capacitance curves C1, C2 . . . Cn of the radiation unit RU in the practical situation can be obtained by substituting A (the sum of overlapping areas of the common electrode 31 and the pixel electrode 32) and d (the distance between the common electrode 31 and the pixel electrode 32) into the aforementioned equation.

Figure 6B:
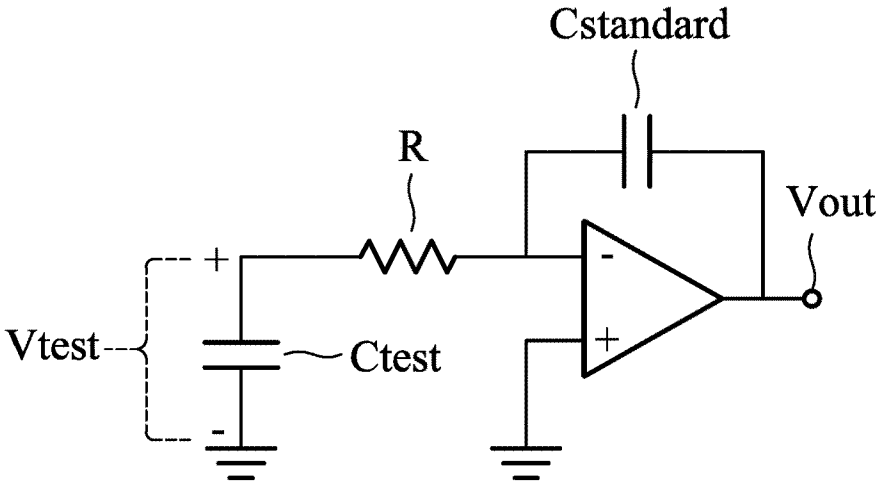
FIG. 6B is an equivalent circuit diagram of FIG. 6A after connecting to a test capacitance.
Figure 6A:
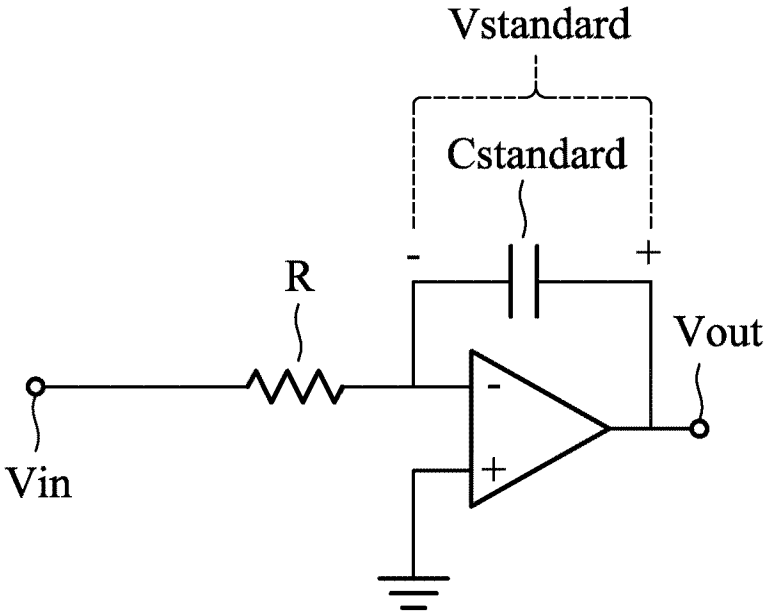
FIG. 6A is an equivalent circuit diagram of an integrator for measuring a capacitance of a radiation unit of an embodiment of the present disclosure.

The corrected voltage-capacitance curves C1, C2 . . . Cn may not only be obtained by the aforementioned equation but also be acquired by directly measuring and calculating the liquid-crystal capacitance $C_{LC}$ of the radiation unit RU in the practical situation. Referring to FIG. 6A, which is an equivalent circuit diagram of an integrator for measuring a capacitance of a radiation unit in an embodiment of the present disclosure. First, the accumulated standard electric quantity $Q_{standard}$ of the standard capacitance $C_{standard}$ with known capacitance value under the standard applied voltage $V_{standard}$ can be calculated through the integrator according to the following equation 2.

$$Q_{standard}=C_{standard}\times V_{standard} \quad \text{(Equation 2)}$$

Next, referring to FIG. 6B, a fully charged test capacitance (capacitance to be tested) $C_{test}$ (for example, a capacitance formed by the radiation unit RU) may connect with the integrator of FIG. 6A, wherein the reduction of the discharge electric quantity $Q_{discharge}$ results from the discharge of the standard capacitance $C_{standard}$ as shown in the following equation 3:

$$Q_{discharge}=C_{standard}\times V_{out} \quad \text{(Equation 3)}$$

Here, output voltage $V_{out}$ is a function of time t as shown in the following equation 4:

$$V_{out}(t) = -\frac{1}{RC_{standard}}\int_{t_{start}}^{t_{end}} V_{in}(t)dt + V_{standard} \quad \text{(Equation 4)}$$

In Equation 4, R is the resistance value of the resistor R connected with the aforementioned integrator, $V_{in}(t)$ is a function of the input voltage $V_{in}$ to the time t, $t_{start}$ and $t_{end}$ are the start time and the end time of the input voltage.

Subsequently, as shown in Equation 5, the electric quantity $Q_{test}$ of the test capacitance $C_{test}$ is obtained by subtracting discharge electric quantity $Q_{discharge}$ from the standard electric quantity $Q_{standard}$:

$$Q_{test}=Q_{standard}-Q_{standard} \quad \text{(Equation 5)}$$

Since the voltage difference $V_{test}$ of the fully charged test capacitance $C_{test}$ is known, test capacitance $C_{test}$ is obtained by the following equation 6:

$$C_{test} = \frac{Q_{test}}{V_{test}} \quad \text{(Equation 6)}$$

Figure 7A:
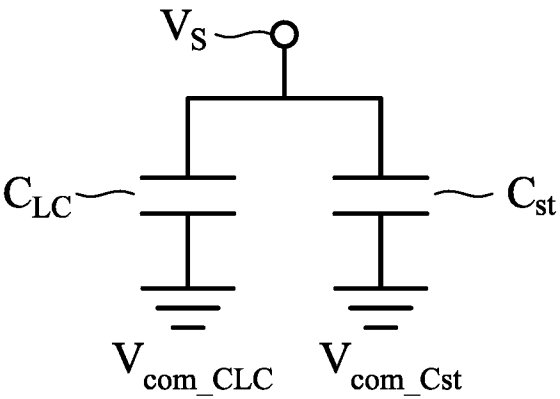
FIGS. 7A-7C are equivalent circuit diagrams of the radiation unit of FIG. 1 at different voltages.
Figure 7B:
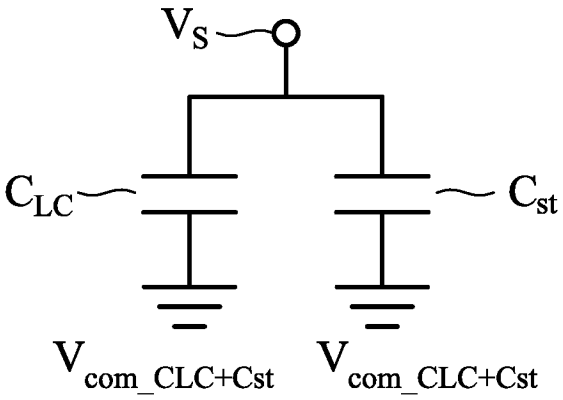
Figure 7C:
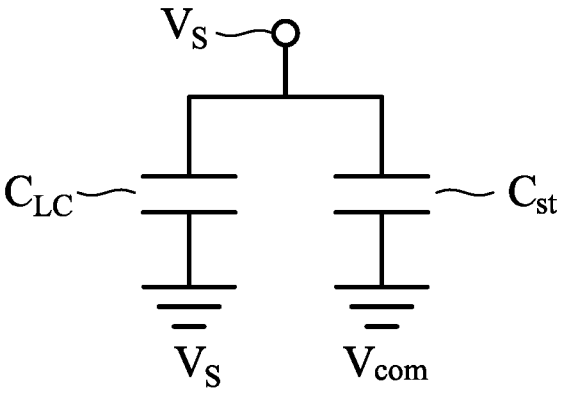

However, as the capacitance formed by the radiation unit RU includes the liquid-crystal capacitance $C_{LC}$ and the storage capacitance $C_{st}$ (which includes parasitic capacitance as well) of the radiation unit RU, a special circuit design is needed to determine the liquid-crystal capacitance $C_{LC}$ of the radiation unit RU. FIGS. 7A-7C, which represent equivalent circuit diagrams of the radiation unit of FIG. 1 at different voltages. As shown in FIG. 7A, the equivalent circuit of the radiation unit RU includes the source terminal which receives the source voltage $V_S$, wherein the liquid-crystal capacitance $C_{LC}$ and the storage capacitance $C_{st}$ connect to a common voltage terminal $V_{com_CLC}$ and $V_{com_CLC}$ respectively.

First, as shown in FIG. 7B, a voltage $V_{com_CLC+Cst}$ may be applied to the common voltage terminals $Vcom_{_CLC}$ and $V_{com_Cst}$ of the liquid-crystal capacitance $C_{LC}$ and the storage capacitance $C_{st}$, and the voltage $Vcom_{_CLC+Cst}$ is not equal to the source voltage $V_S$, so as to measure and calculate the parallel equivalent capacitance value of the liquid-crystal capacitance $C_{LC}$ and the storage capacitance $C_{st}$.

Referring to FIG. 7C, a voltage equal to the source voltage $V_S$ may be applied to the common voltage terminal $V_{com_CLC}$ of the liquid-crystal capacitance $C_{LC}$, and the other voltage $V_{com}$ may be applied to the common voltage terminal $V_{com_Cst}$ of the storage capacitance $C_{st}$, wherein the voltage $V_{com}$ is not equal to the source voltage $V_S$, so as to measure and calculate the capacitance value of the storage capacitance $C_{st}$. Next, the liquid-crystal capacitance $C_{LC}$ of the radiation unit RU can be obtained by subtracting the single capacitance value of the storage capacitance Cst from the parallel equivalent capacitance value of the liquid-crystal capacitance $C_{LC}$ and the storage capacitance $C_{st}$.

As a result, the corrected voltage-capacitance curve C1, C2 . . . Cn of each radiation unit RU can be obtained by the two aforementioned methods, and the initial voltage-capacitance curve $C_{initial}$ (FIG. 5A) and the corrected voltage-capacitance C1, C2 . . . Cn (FIG. 5B) will be stored in the correction module 12 in order to correct the initial voltage signal S1, S2 . . . Sn. Taking the first radiation unit RU1 as an example, after the correction module 12 receives the initial voltage signal S1 corresponding to the first radiation unit RU1, the correction module 12 can determine an initial capacitance value $C_0$ corresponding to the initial voltage signal S1 ($V_0$ in FIG. 5A) according to an initial voltage-capacitance curve, subsequently determine a corrected voltage signal S1' ($V_1$ in FIG. 5A) corresponding to the initial capacitance value $C_0$ according to the corrected voltage-capacitance curve C1 of the first radiation unit RU1, and then output the corrected voltage signal S1' to the aforementioned first radiation unit RU1. The initial voltage signal S1 corresponding to the first radiation unit RU1 is different from the corrected voltage signal S1' due to the correction. In some embodiments, initial voltage-capacitance curve $C_{initial}$ and the corrected voltage-capacitance curves C1, C2 . . . Cn may be stored in the lookup table 121 of the correction module 12, but are not limited thereto.

The present disclosure provides two methods for obtaining the corrected voltage-capacitance curves C1, C2 . . . Cn, but those are merely examples and are not intended to be limited.

In summary, the present disclosure utilizes the correction module 12 to correct the voltage signal outputting to the radiation unit RU, which can improve the output electromagnetic wave distortion caused by the non-uniformity of the liquid-crystal layer or the difference of the electrode areas due to the limitation of the process capability of precision, so as to achieve the desired output electromagnetic radiation patterns.

The disclosed features may be combined, modified, or replaced in any suitable manner in one or more disclosed embodiments, but are not limited to any particular embodiments.

While the disclosure has been described by way of example and in terms of preferred embodiment, it is to be understood that the disclosure is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A liquid-crystal antenna device, comprising:

a signal source, providing an input electromagnetic wave;

a driving module, outputting a plurality of initial voltage signals according to a radiation address;

a correction module, receiving the plurality of initial voltage signals and outputting a plurality of corrected voltage signals according to a lookup table; and a plurality of radiation units, receiving the plurality of corrected voltage signals and coupling with the input electromagnetic wave to generate an output electromagnetic wave.

2. The liquid-crystal antenna device as claimed in claim 1, wherein the lookup table includes an initial voltage-capacitance curve, and a plurality of corrected voltage-capacitance curves respectively corresponding to the plurality of radiation units, and wherein the correction module determines a plurality of initial capacitance values that respectively correspond to the plurality of initial voltage signals according to the initial voltage-capacitance curve, and then determines the plurality of corrected voltage signals that respectively correspond to the plurality of initial capacitance values according to the plurality of corrected voltage-capacitance curves.

3. The liquid-crystal antenna device as claimed in claim 1, wherein each of the radiation units comprises a common electrode, a pixel electrode, and a liquid-crystal layer disposed between the common electrode and the pixel electrode.

4. The liquid-crystal antenna device as claimed in claim 3, wherein each of the radiation units further comprises a thin film transistor electrically connected to the pixel electrode.

5. The liquid-crystal antenna device as claimed in claim 3, wherein the common electrode comprises a slit.

6. The liquid-crystal antenna device as claimed in claim 5, wherein the pixel electrode overlaps the slit.

7. The liquid-crystal antenna device as claimed in claim 3, wherein the pixel electrode receives one of the plurality of corrected voltage signals.

8. The liquid-crystal antenna device as claimed in claim 1, further comprising a waveguide transmitting the input electromagnetic wave from the signal source to the plurality of radiation units.

9. The liquid-crystal antenna device as claimed in claim 1, wherein at least one of the plurality of initial voltage signals is different from at least one of the plurality of corrected voltage signals.

10. A liquid-crystal antenna device, comprising:

a plurality of radiation units, emitting or receiving an electromagnetic wave, wherein the radiation units include a first radiation unit;

a driving module, outputting a plurality of initial voltage signals according to a radiation address, wherein the plurality of initial voltage signals include a first voltage signal corresponding to the first radiation unit; and a correction module, receiving the plurality of initial voltage signals and outputting a plurality of corrected voltage signals to the plurality of radiation units, wherein the plurality of corrected voltage signals include a second voltage signal corresponding to the first radiation unit;

wherein the first voltage signal is different from the second voltage signal, wherein the correction module determines an initial capacitance value that corresponds to the first voltage signal according to an initial voltage-capacitance curve, and then determines the second voltage signal that corresponds to the initial capacitance value according to a corrected voltage-capacitance curve.

11. The liquid-crystal antenna device as claimed in claim 10, wherein each of the radiation units comprises a common electrode, a pixel electrode, and a liquid-crystal layer disposed between the common electrode and the pixel electrode.

12. The liquid-crystal antenna device as claimed in claim 11, wherein each of the radiation units further comprises a thin film transistor electrically connected to the pixel electrode.

13. The liquid-crystal antenna device as claimed in claim 11, wherein the common electrode comprises a slit.

14. The liquid-crystal antenna device as claimed in claim 13, wherein the pixel electrode overlaps the slit.

15. The liquid-crystal antenna device as claimed in claim 11, wherein the pixel electrode receives one of the plurality of corrected voltage signals.

16. The liquid-crystal antenna device as claimed in claim 10, further comprising a signal source providing the electromagnetic wave.

17. The liquid-crystal antenna device as claimed in claim 16, further comprising a waveguide transmitting the electromagnetic wave from the signal source to the plurality of radiation units.

* * * * *